US005788611A

United States Patent [19]

Kuo

[11] Patent Number: 5,788,611

[45] Date of Patent: Aug. 4, 1998

[54] COLLAPSIBLE TREADMILL

[76] Inventor: Hai Pin Kuo, P.O. Box 82-144, Taipei, Taiwan

[21] Appl. No.: 925,752

[22] Filed: Sep. 9, 1997

[51] Int. Cl.[6] ..... A63B 22/02

[52] U.S. Cl. ..... 482/54; 482/51

[58] Field of Search ..... 482/51, 54

[56] References Cited

U.S. PATENT DOCUMENTS

| | | | |
|---|---|---|---|
| 931,394 | 8/1909 | Day | 482/54 |
| 4,066,257 | 1/1978 | Moller | 482/54 |
| 4,679,787 | 7/1987 | Guilbault | 482/54 |
| 4,757,987 | 7/1988 | Allemand | 482/54 |
| 5,344,372 | 9/1994 | Hung | 482/54 |
| 5,662,557 | 9/1997 | Watterson et al. | 482/54 |
| 5,702,325 | 12/1997 | Watterson et al. | 482/54 |

*Primary Examiner*—Lynne A. Reichard
*Attorney, Agent, or Firm*—A & J

[57] ABSTRACT

A collapsible treadmill includes a base, a pivot seat at a front portion of the base, an upright bar mounted in the pivot seat, a securing bar fixedly disposed on the upright bar, and two grip bars. The grip bars are locked to the securing bar at their top ends and to the base at their bottom ends. When the treadmill is not in use, the grip bars and the upright bar may be lowered in the direction of the base so as to reduce the size of the treadmill as a whole for easy storage.

1 Claim, 5 Drawing Sheets

COLLAPSIBLE TREADMILL

BACKGROUND OF THE INVENTION

1. Field of the Invention

This invention relates generally to a treadmill, and more particularly to an improved collapsible treadmill.

2. Description of the Prior Art

Treadmills are popular exercising apparatus. However, due to their size they occupy more floor space than such exercising apparatus as rowers, steppers, and exercise bikes. For city dwellers whose living space is limited, it is a problem to install a treader at home.

It is, therefore, desirable to have a treadmill which is collapsible so as to save floor space when not in use.

SUMMARY OF THE INVENTION

This invention relates generally to a treadmill, and more particularly to an improved collapsible treadmill.

A primary object of the present invention is to provide a collapsible treadmill which may be folded to facilitate placement and storage when it is not in use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
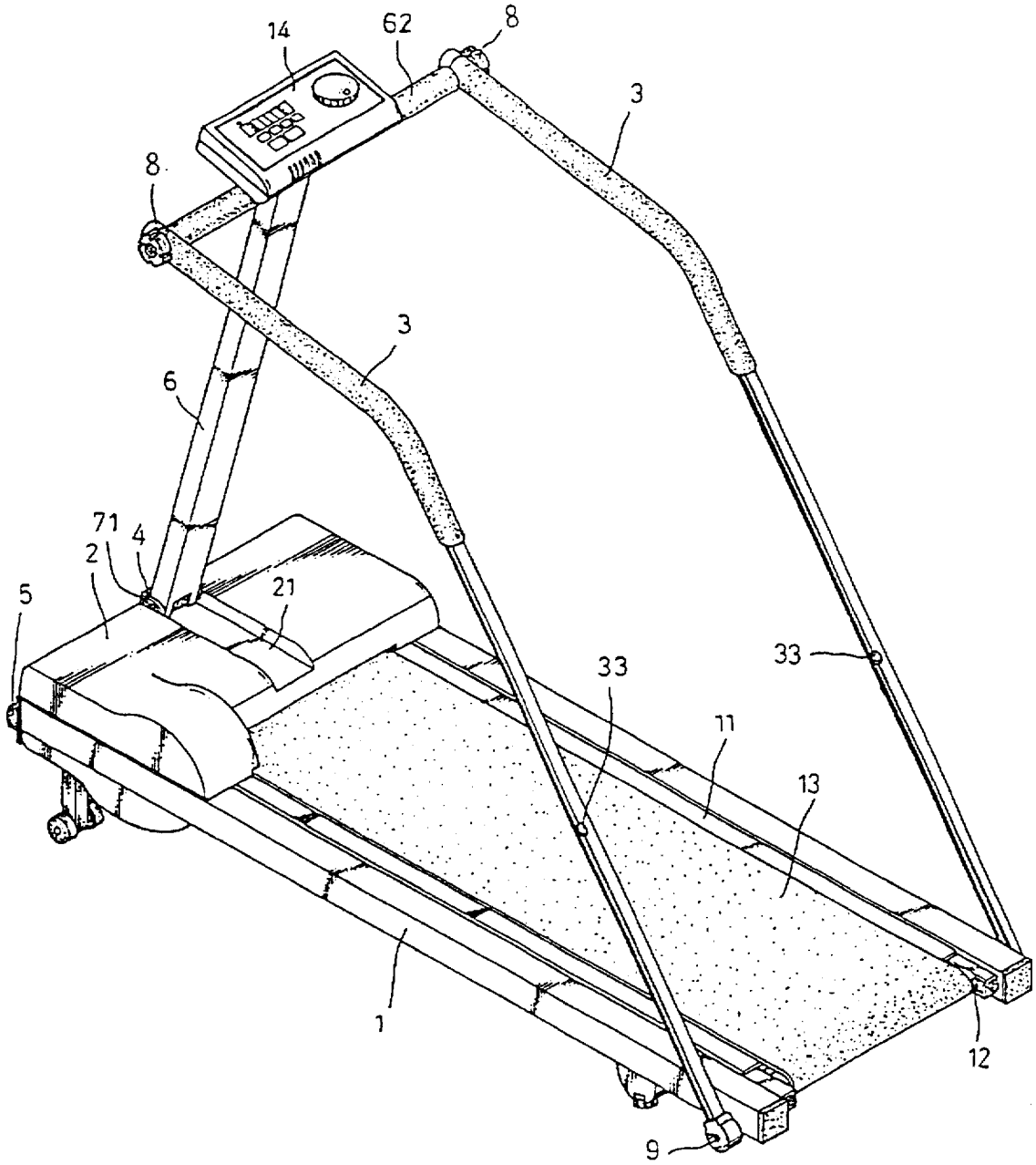
FIG. 1 is a perspective assembled view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIG. 1, the treadmill of the present invention essentially comprises a base 1 which is substantially rectangular and has a front portion and a rear portion, a cover 2 disposed at one end of the base for covering a transmission motor (not shown) and related components (not shown) driven by the transmission motor, a couple of grip bars 3, and an upright bar 6. The base 1 includes a tread board 11, a rear shaft 12 (a front shaft being concealed by the cover 2 and therefore not shown), and a rotary tread belt 13.

Figure 2:
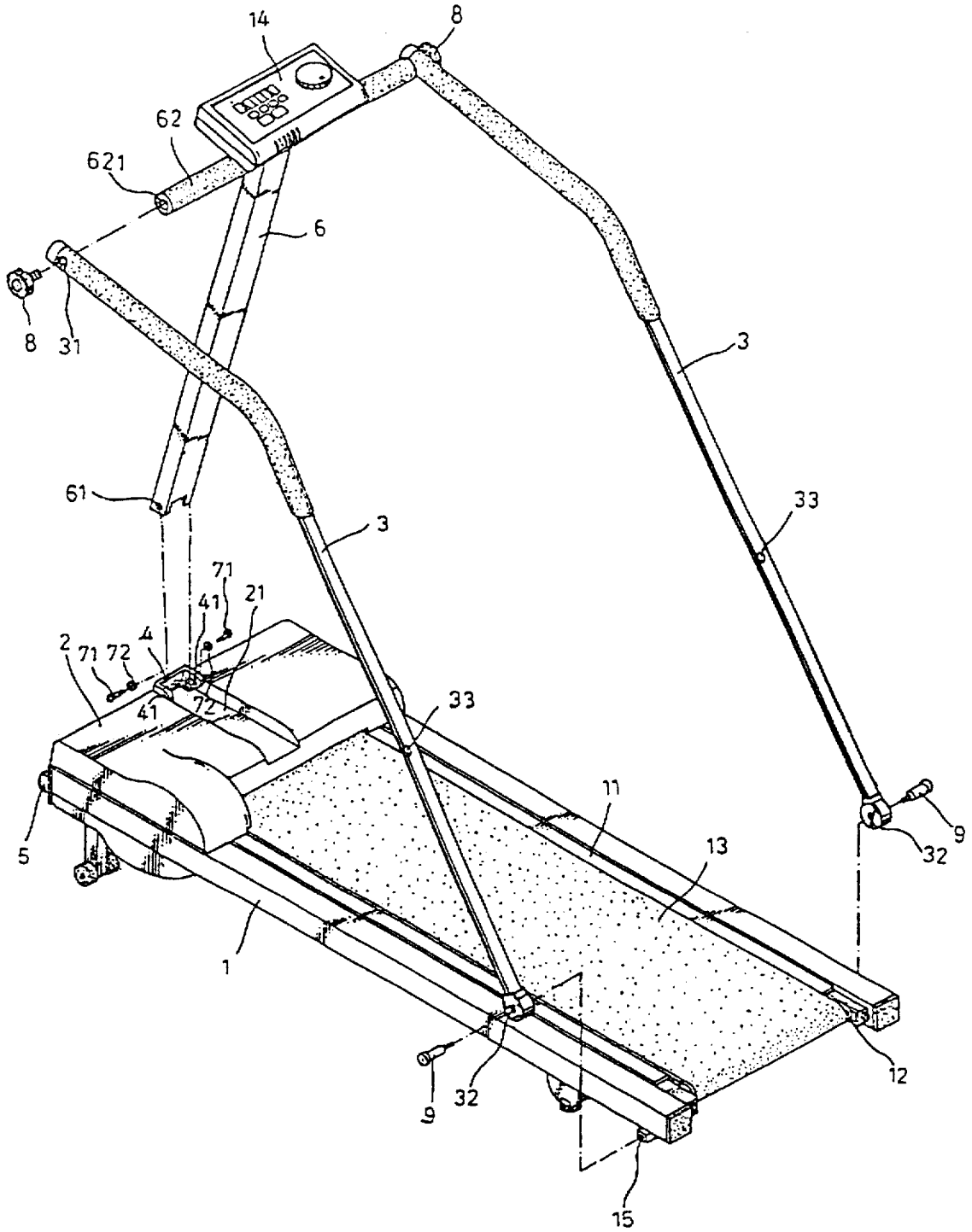
FIG. 2 is a perspective exploded view of the present invention.

Certainly, the treadmill of the invention may be provided with an electronic dashboard 14 to allow the user to set the desired exercising mode and to display relevant data. The treadmill of the present invention is characterized in that it is collapsible. With further reference to FIG. 2, the base 1 is provided with a pivot seat 4 at a center of the front portion, the pivot 4 seat having two side wings each having a round hole 41, two support blocks 5 respectively disposed at both ends of the front portion, and two positioning posts 15 with central holes being disposed at both sides of the rear portion of the base 1.

The upright bar 6 has a top end and a bottom end, the top end being provided with two round through holes 61, the bottom end being provided with a securing bar 62 running perpendicular to the upright bar 6. The securing bar has two ends each having a screw hole 621. Bolts 71 may be provided to extend through the round holes 41 of the pivot seat 4 and the round through holes 61 of the upright bar 6 and then locked in position by nuts 72 so as to enable the upright bar 6 to swing downwardly with the pivot seat 4 as pivot.

The grip bars 3 are symmetrical in structure of a suitable length and a shape suitable for gripping by users. They are respectively disposed at both sides of the securing bar 62 and have top ends and bottom ends. Each grip bar 3 has a top through hole 31 and a bottom through hole 32 at the top and bottom ends respectively. Each grip bar 3 further has a through bore 33 near the bottom through hole 32. Locking elements 8 may be used to pass through the top and bottom through holes 31, 32 of the grip bars 3 to lock the grip bars 3 to the screw holes 621 of the securing bar 62. Pivot posts 9 having a threaded section are used to pass through the bottom through holes 32 of the grip bars 3 to lock the grip bars to the positioning posts 15 at both sides of the rear portion of the base 1, so that the two grip bars 3 may be completely positioned at the base 1 and the securing bar 62.

The cover 2 may be positioned at the front portion of the base 1. It is provided with a receiving slot 21 of a width corresponding to that of the cross section of the upright bar 6 so that the bottom end of the upright bar 6 may be inserted into the receiving slot 21.

Figure 3:
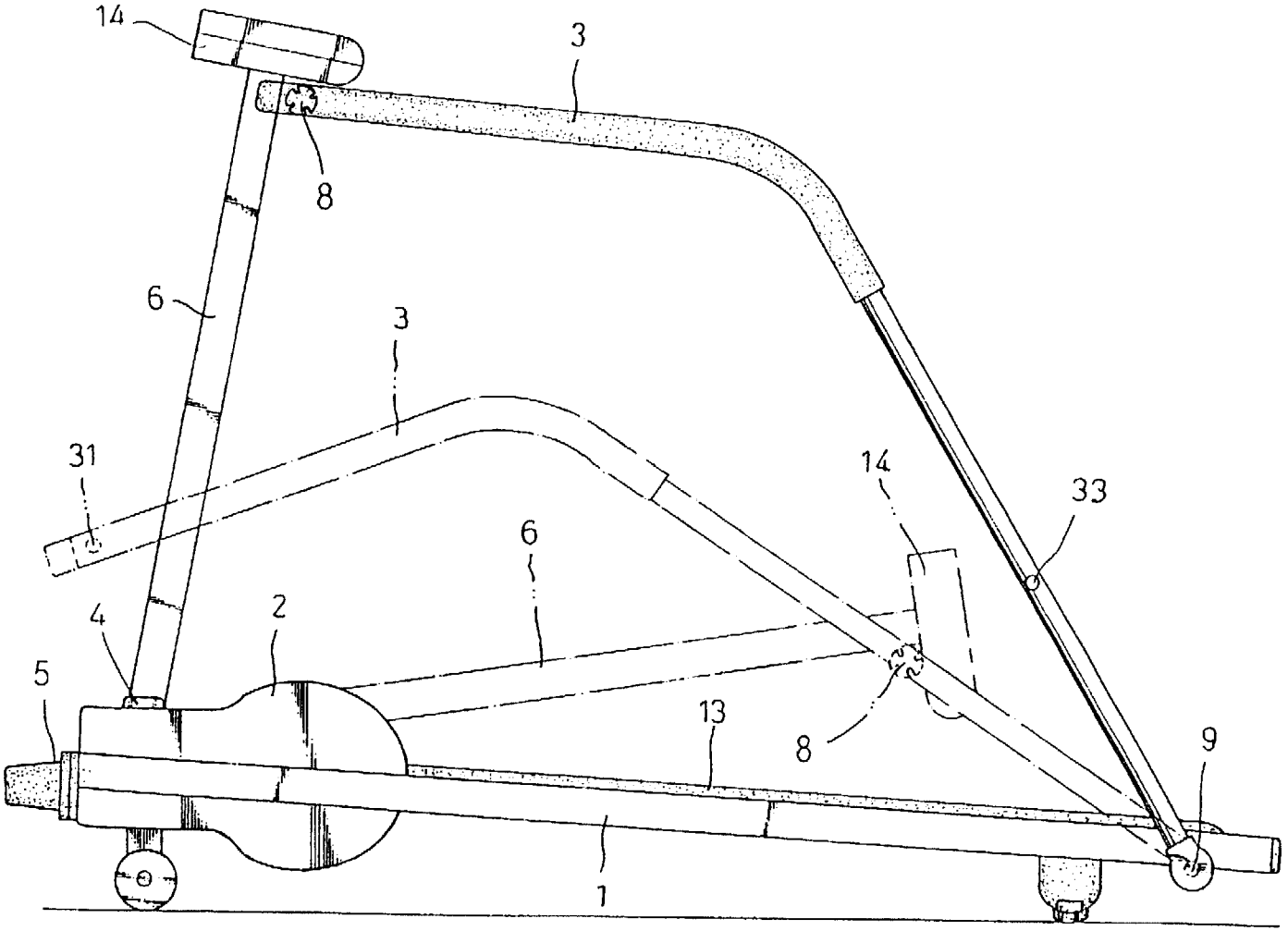
FIG. 3 is a schematic view of the present invention in a folded state.
Figure 4:
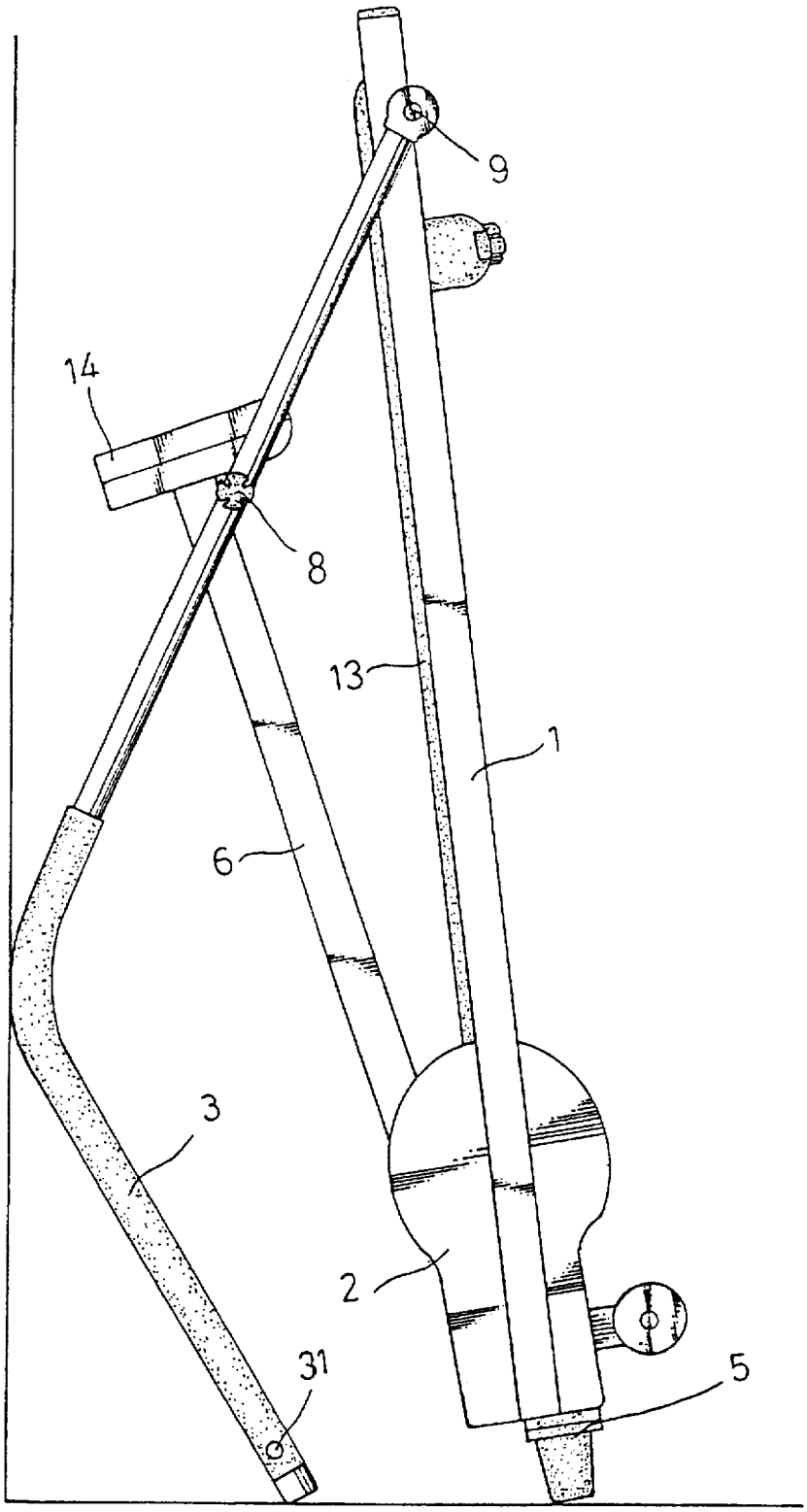
FIG. 4 is a schematic view of the present invention placed vertically after folding.
Figure 5:
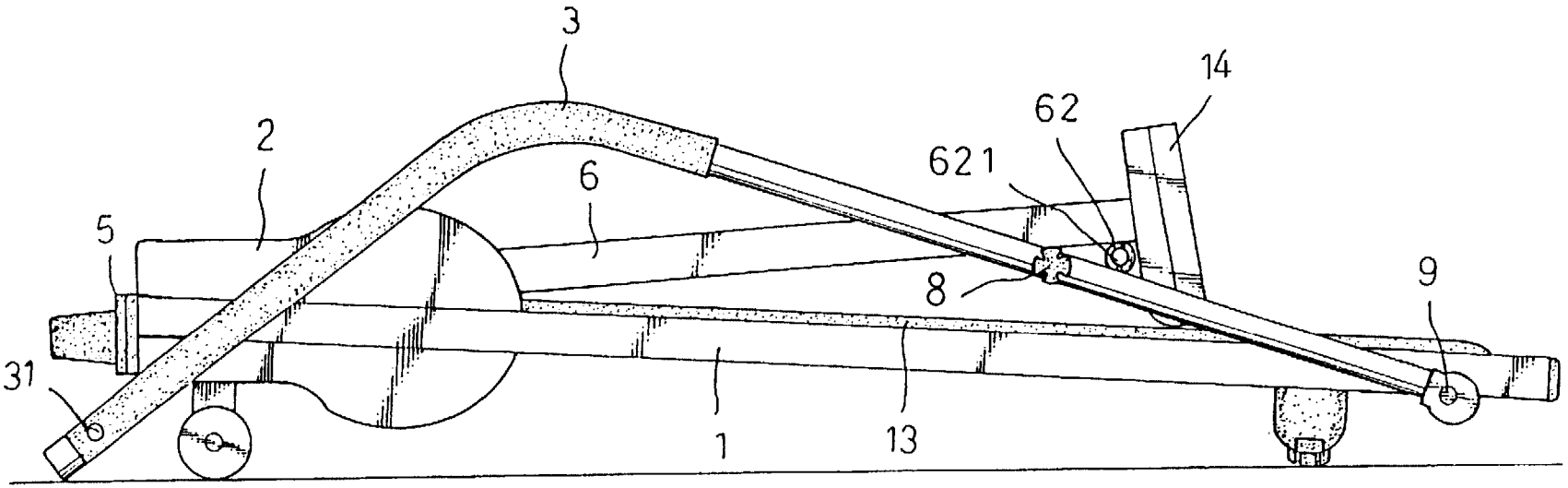
FIG. 5 is a schematic view of the present invention placed horizontally after folding.

After assembly, the treadmill of the invention is as that shown in FIG. 1. The entire treadmill may be placed on the floor for training purposes. When the treadmill is not in use, the user may remove the locking elements 8 so that the top ends of the grip bars 3 disengage from the securing bar 62. Since the bottom ends of the grip bars 3 turn using the pivot posts 9 as pivoting points, both grip bars 3 may be lowered toward the base 1. On the other hand, as the bottom end of the upright bar 6 is also movably, pivotally connected with the pivot seat 4 of the base 1, the upright bar 6 may be lowered in the direction of the base 1, with the bottom end of the upright bar 6 extending into the receiving slot 21 of the cover 2. The locking elements may then be inserted through the through bores 33 of the grip bars 3 to lock the grip bars 3 to the screw holes 62 of the securing bar 62 connected to the thus lowered upright bar 6, as shown in FIG. 3. Hence, the height of the treadmill is reduced (shown by imaginary lines in FIG. 3), which also means that the size of the treadmill is reduced. The user may then erect the originally horizontally placed treader. By means of the support blocks 5 at the front portion of the base 1 and the front ends of the grip bars 3 which support the treadmill vertically on the floor, the thus collapsed treader may be stored at a corner of the room (as shown in FIG. 4). It can therefore be appreciated that the treadmill of the present invention is easy to collapse for storage and occupies much less floor space. Since most of the weight of the treadmill is concentrated at the transmission motor at the front portion of the base 1, after the treadmill is erected, the weight of the treadmill is just located at the cover 2 near the floor surface. In addition, the entire treadmill is supported at four points by the two support blocks 5 and the top ends of the two grip bars 3, so that the center of gravity of the treadmill placed in an upright position is low and the treadmill may be stably supported on the floor. It will not easily fall down to hurt anyone. Furthermore, referring to FIG. 5, the user may only position the locking elements 8 in the through bores 33 of the grip bars 3 without locking the grip bars 3 to the screw holes 621 of the securing bar 62 so that the grip bars 3 and the upright bar 6 may be lowered to the lowest level to further reduce the height of the treadmill to allow the treadmill to be stored under the bed.

In summary, as existing treadmills are not collapsible and therefore require large floor space, the collapsible treadmill of the present invention is a vast advancement in the art.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A collapsible treadmill comprising:

a base having a front portion, a rear portion, a pivot seat disposed at a center of said front portion, two support blocks respectively disposed at both sides of said front portion, and two positioning posts respectively disposed at both sides of said rear portion;

an upright bar having a top end, a bottom end, and a securing bar secured to said bottom end and being perpendicular to said upright bar, said securing bar having two ends provided with respective screw holes, said bottom end having round holes at both sides respectively, said bottom end of said upright bar being pivotally secured to said pivot seat of said base using bolts and nuts;

two grip bars, having symmetrical structure and being of a suitable length and a shape adapted for holding by users, said grip bars each having a top end with a top through hole, a bottom end with a bottom through hole, and a through bore near said bottom through hole, said top ends of said grip bars being locked to said securing bar by means of locking elements passing through said top through holes of said grip bars and said screw holes of said securing bar, and said bottom ends of said grip bars being locked to said base by means of pivot posts having a threaded section passing through said bottom through holes into said positioning posts; and a cover, being located at said front portion of said base and having a receiving slot of a width matching that of said upright bar such that said upright bar may insert into and be received in said receiving slot when said treadmill is collapsed;

whereby said treadmill is collapsible to occupy less floor space and conveniently stored when not in use.

* * * * *